US008459312B2

(12) United States Patent
Manera et al.

(10) Patent No.: US 8,459,312 B2
(45) Date of Patent: Jun. 11, 2013

(54) PRESS IN BOTTLE ADAPTER

(75) Inventors: David A. Manera, Buena, NJ (US); Victoria Moore O'Brien, Sewell, NJ (US); Brian Myers, Williamstown, NJ (US); Daniel R. Hoffman, Mantua, NJ (US); John D. Buehler, Bridgeton, NJ (US)

(73) Assignee: Comar, Inc., Buena, NJ (US)

( * ) Notice: Subject to any disclaimer, the term of this patent is extended or adjusted under 35 U.S.C. 154(b) by 353 days.

(21) Appl. No.: 12/825,786

(22) Filed: Jun. 29, 2010

(65) Prior Publication Data

US 2010/0327010 A1 Dec. 30, 2010

Related U.S. Application Data

(60) Provisional application No. 61/221,728, filed on Jun. 30, 2009.

(51) Int. Cl.
*B65B 1/04* (2006.01)
*B65B 39/00* (2006.01)

(52) U.S. Cl.
USPC ..... 141/27; 141/23; 141/301; 141/319; 141/346; 215/50; 215/311

(58) Field of Classification Search
USPC ..... 141/23, 25, 26, 27, 301, 319, 325, 141/326, 346, 347; 215/50, 247, 311
See application file for complete search history.

(56) References Cited

U.S. PATENT DOCUMENTS

| | | | | |
|---|---|---|---|---|
| 2,290,348 | A * | 7/1942 | Moule | 604/415 |
| 2,783,908 | A * | 3/1957 | Winfield | 215/247 |
| 4,515,752 | A * | 5/1985 | Miramanda | 422/568 |
| 4,573,506 | A * | 3/1986 | Paoletti | 141/98 |
| 5,088,612 | A | 2/1992 | Storar et al. | |
| 5,429,256 | A * | 7/1995 | Kestenbaum | 215/247 |
| 5,620,434 | A | 4/1997 | Brony | |
| 5,688,254 | A | 11/1997 | Lopez et al. | |
| 5,931,828 | A * | 8/1999 | Durkee | 604/403 |
| 5,971,181 | A * | 10/1999 | Niedospial et al. | 215/247 |
| 7,128,228 | B2 * | 10/2006 | Collins | 215/247 |
| 7,681,750 | B2 * | 3/2010 | Jackel | 215/235 |
| 7,832,581 | B2 * | 11/2010 | Van Cromvoirt | 215/355 |

FOREIGN PATENT DOCUMENTS

| | | |
|---|---|---|
| WO | 02085429 | 10/2002 |

OTHER PUBLICATIONS

The International Search Report and Written Opinion by the International Searching Authority, mailed on Sep. 2, 2010, in the PCT application No. PCT/US10/40614.

* cited by examiner

*Primary Examiner* — Timothy L Maust

(74) *Attorney, Agent, or Firm* — Montgomery, McCracken, Walker & Rhoads, LLP

(57) ABSTRACT

An adapter to be pressed into the neck of a bottle to receive a syringe for accessing the bottle contents by a syringe. The adapter has a distal end that extends into the bottle and a normally closed valve located at that distal end to prevent the contents from leaking out of the bottle if the bottle is inverted. An upper flange of the adapter seats against the top of the bottle and is recessed into the top of the bottle to prevent easy access to pry the adapter out of the bottle. A cap is also disclosed that is adapted to be pressed into the neck of a bottle. The cap has an upper lid that is hinged to a lower body to allow the upper hinge to move between a closed position sealing the bottle and an open position where the bottle is accessible by a syringe.

18 Claims, 10 Drawing Sheets

PRESS IN BOTTLE ADAPTER

CROSS REFERENCE TO RELATED CASE

This application claims priority from U.S. Provisional Patent Application No. 61/221,728 filed Jun. 30, 2009, entitled "Press in Bottle Adapters" which is incorporated herein by reference.

FIELD OF THE INVENTION

The present invention relates to adapters that are pressed into the open end of a bottle neck to allow the use of a dispenser such as a syringe with a bottle, and, more particularly, to a press in adapter that can be pressed into the open end of a bottle which restricts leakage from the bottle and resists removal from the bottle.

BACKGROUND OF THE INVENTION

There are, today, bottle adapters that are used for children's medications and allows a bottle to be accessed by a syringe so that the caregiver can administer that dosage of the medicine to the child. Basically, the adapter is located at the top of the bottle neck to create a syringe accessibility to that bottle. They are pressed into the open top of the bottle to make assembly relatively cost effective and have a central opening through which a dispenser or syringe can be inserted to reach and withdraw the medicine from the bottle.

With the present adapters, however, there are some problems, in that children can bypass the adapter and access the content of the bottle, either by effecting some bypass method or by the removal of the adapter in its entirety. It is estimated that about 180,000 children each year are seen for medication overdoses and the main issue in such overdoses is the unsupervised ingestion of the medicine.

For example, one issue with existing adapters is that the central opening can be used by a child to access the medicine by inverting the bottle and shaking, sucking or otherwise manipulating the bottle to access the medicine. There is, also the possibility that the bottle may be overturned, either deliberately or inadvertently, and the contents leak out of that central opening.

Another problem with the present adapters, is that there is an upper flange that sits atop the upper edge of the neck of the bottle such that a child, or other person can insert a tool, fingernail, or even teeth to pry the adapter out of the bottle neck and thus expose the medicine to a child.

It would therefore be advantageous to have an improved bottle adapted that can be pressed into the bottle and which provides enhanced protection against access to the content of the bottle by persons, such as children.

SUMMARY OF THE INVENTION

Accordingly, the present invention overcomes the difficulties heretofore encountered with present press in bottle adapters. With the present invention, the adapter has a valve located at its distal end that resides within the neck of the bottle. The valve prevents the spillage of medicine from the bottle if the bottle is inadvertently overturned or there is a deliberate attempt by a child to gain access to the medicine within the bottle. As will be appreciated by those skilled in the art, the valve can be of different constructions and is not limited to the specific configurations disclosed.

In one embodiment of the present invention, the valve may be a two piece construction. In this embodiment, the adapter has a two-piece valve, such as a duck bill valve at its distal end that is snapped or molded on to the adapter. The valve is opened as the dispenser or syringe penetrates the duck bill valve so that access can be gained by the dispenser or syringe to the medicine within the bottle.

In an alternative embodiment, the valve can be constructed as a unitary adapter such that the adapter and valve are molded together in a one-piece design.

In another exemplary embodiment, the valve has a dome-shaped valve member that is flexible and is distorted by the dispenser or syringe as it is introduced into the bottle. The dome shaped member flexes inwardly by the advancement of the distal end of the dispenser or syringe to open a passageway for the dispenser or syringe to access the medicine within the bottle.

As a advantageous feature, the adapters heretofore described, have an upper flange that is recessed or countersunk with the top of the neck of the bottle so that it is considerably difficult to gain access to the underside of the upper flange to pry the adapter out of the neck of the bottle to gain access to the medicine.

There is a further exemplary embodiment comprising a molded cap that is adapted to be affixed to the neck of a bottle. In this embodiment, the cap has a lower body and an upper lid that is hingedly affixed to the lower body, such as by the use of a living hinge. The upper lid can then be moved between a closed position where the central opening in the cap is closed and an upper position where the central opening is open and accessible by a syringe. There is a locking system that locks the upper lid in its closed position and the locking system requires a deliberate action by the user to open the upper lid to gain access to the medicine within the bottle.

Again, with the embodiment of a cap covering the neck of the bottle, there is a valve at the distal end of the cap that extends into the bottle and the valve can be opened by the physical insertion of a dispenser or syringe in the manner described with respect to the adapters.

In another embodiment of the present invention, the adapter does not utilize a valve at the distal end, but instead relies on a reduced opening in conjunction with the other features disclosed to restrict the inadvertent or unintentional flow of fluid from the bottle.

These and other features and advantages of the present invention will become more readily apparent during the following detailed description taken in conjunction with the drawings herein.

DETAILED DESCRIPTION OF THE INVENTION

Figure 1:
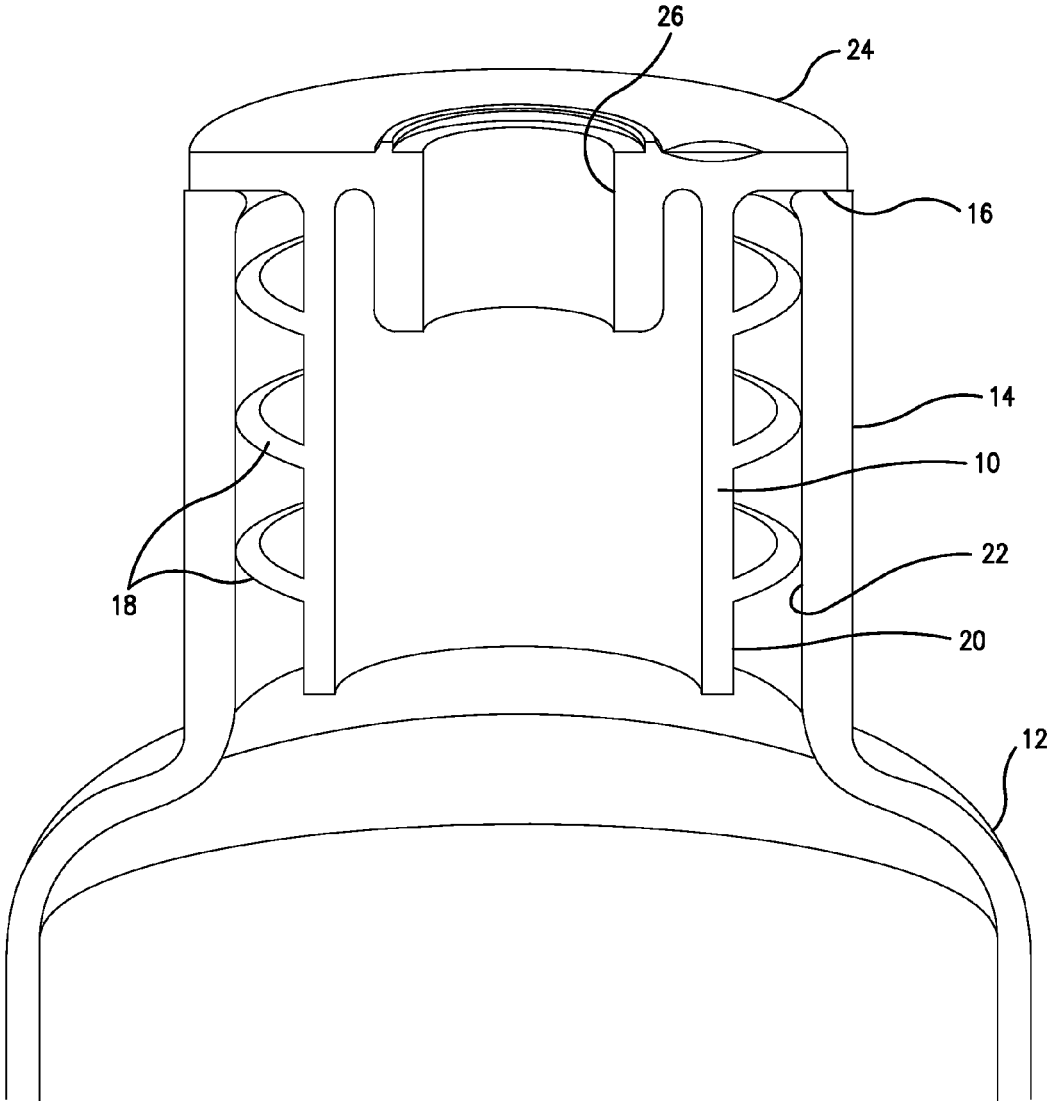
FIG. 1 PRIOR ART
FIG. 1 is a cross-sectional view of a conventional bottle adapter in its operative position interfitted into the top of a bottle.

Referring now to FIG. 1, there is shown a cross-sectional view of a conventional bottle adapter 10 currently being used commercially. As can be seen, the bottle 12 has an upstanding neck 14 having an upper, cylindrical surface 16. The adapter 10 includes a plurality of fins 18 that extend outwardly from a cylindrical portion 20 of the adapter 10 and press against the inside surface 22 of the neck 14 to retain the adapter 10 firmly in position after being pressed into the neck 14 of the bottle 12.

The adapter 10 has an upper flange 24 that closes the neck 14 of the bottle 12 and which has a central opening 26 through which a syringe can be inserted in gaining access to the medicine that is contained within the bottle 12.

Accordingly, there is a disadvantage with the conventional adapter 10 of FIG. 1 since the upper flange 24 overlaps the upper cylindrical surface 16 of the neck 14 and, therefore, present an opportunity for someone, such as a child, to pry the adapter 10 out of the bottle 12 by inserting a tool, fingernail, or by use of teeth between the upper flange 24 and the upper cylindrical surface 16 of the bottle.

Figure 2:
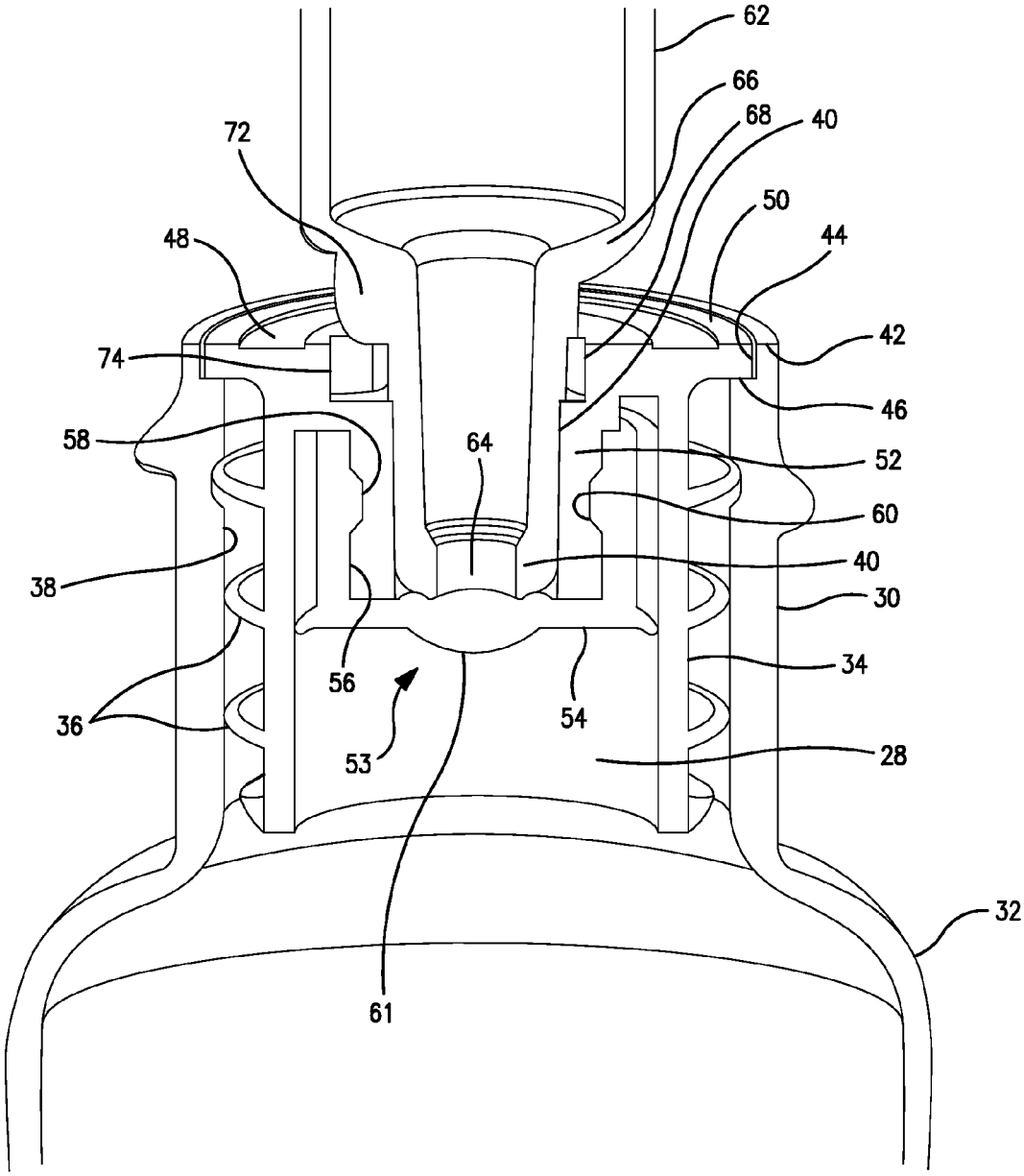
FIG. 2 is a cross-sectional view of an exemplary embodiment of a bottle adapter of the present invention in its operative position interfitted into the top of a bottle.

Turning now to FIG. 2, there is shown a cross-sectional view of an exemplary embodiment of an adapter 28 constructed in accordance with the present invention. As can be seen, the adapter 28 of this embodiment has been pressed into the neck 30 of a bottle 32 so as to be tightly secured thereto. Again, there is a cylindrical portion 34 having fins 36 extending outwardly therefrom to contact and be secured to the inside surface 38 of the neck 30. There is a central opening 40 to allow access by a dispenser or syringe to the medicine within the bottle 32.

In FIG. 2, there can also be seen the upper cylindrical surface 42 of the neck 30 and there is a ledge 44 formed inwardly thereof having an inner cylindrical surface 46. In the interfitting of the adapter 28 to the bottle 32, the upper flange 48 of the adapter 28 thus seats atop of the inner cylindrical surface 46 such that the upper surface 50 of the upper flange 48 is generally aligned and contiguous with the upper cylindrical surface 42, thus making it very difficult to pry the adapter 28 out of its operative position pressed into the neck 30 of bottle 32. In effect, the upper flange 48 is countersunk or recessed into the neck 30 of the bottle 32. The adapter 28 further includes an inner cylindrical portion 52 extending downwardly from the upper flange 48 in the direction toward the bottle 32.

In this embodiment, adapter 28 also includes a valve 53 to prevent the medicine from spilling out of the bottle 32 in case the bottle 32 is inadvertently tipped over or a child tries to access the contents by inverting the bottle 32. The valve 53 is comprised of a valve body 54 made of a molded material having an inner surface 56 of a diameter that fits closely over the inner cylindrical portion 52. An annular projection 58 is formed on the inner surface 56 of the valve body 54 that interfits into an annular depression 60 formed on the inner cylindrical portion 52 such that the valve body 54 can be readily snapped on to the inner cylindrical portion 52 in constructing the adapter 28 additionally, valve 53 may be molded directly on to adapter 28 forming a single contiguous unit.

The lower portion of the valve body 54 is formed as a duck bill valve 61 that is normally closed but opens when an object such as a dispenser is inserted therethrough and the function and purpose of the duck bill valve 61 will later become clear.

As also can be seen in FIG. 2, there is a dispenser 62 that is positioned within the adapter 28 just short of full penetration into the adapter 28 and, of course, into the central opening 40 and into the bottle 32. The dispenser 62 has a distal end 64 that is adapted to be inserted into the bottle 32 to reach the medicine therein and to withdraw the desired amount of the medicine. In the position of FIG. 2, the distal end 64 is shown to be just contacting the duck bill valve 61 and further penetration into the bottle 32 allows the distal end 64 to penetrate the duck bill valve 61 to enter the bottle 32.

The dispenser 62 also includes a cylindrical flange 66 that interfits into an enlarged cylindrical opening 68 that is larger in diameter than the central opening 40. As such, when the dispenser 62 is fully inserted into its operable position into the bottle 32, the cylindrical flange 66 seats in the enlarged cylindrical opening 68.

A key 72 is formed on the dispenser 62 that interfits into a keyway 74 formed in the upper flange 48 of the adapter 28 such that the dispenser 62 must be accurately radially oriented to align the key 72 with the keyway 74 in order to be able to insert the dispenser 62 further into the bottle 32 so as to have the distal end 64 access the medicine. Thus, the dispenser 62 cannot simply be inserted into the bottle 32 but must be carefully oriented, as an adult could do, to actually have the dispenser 62 open the valve to access and remove any medicine within the bottle 32.

Figure 3:
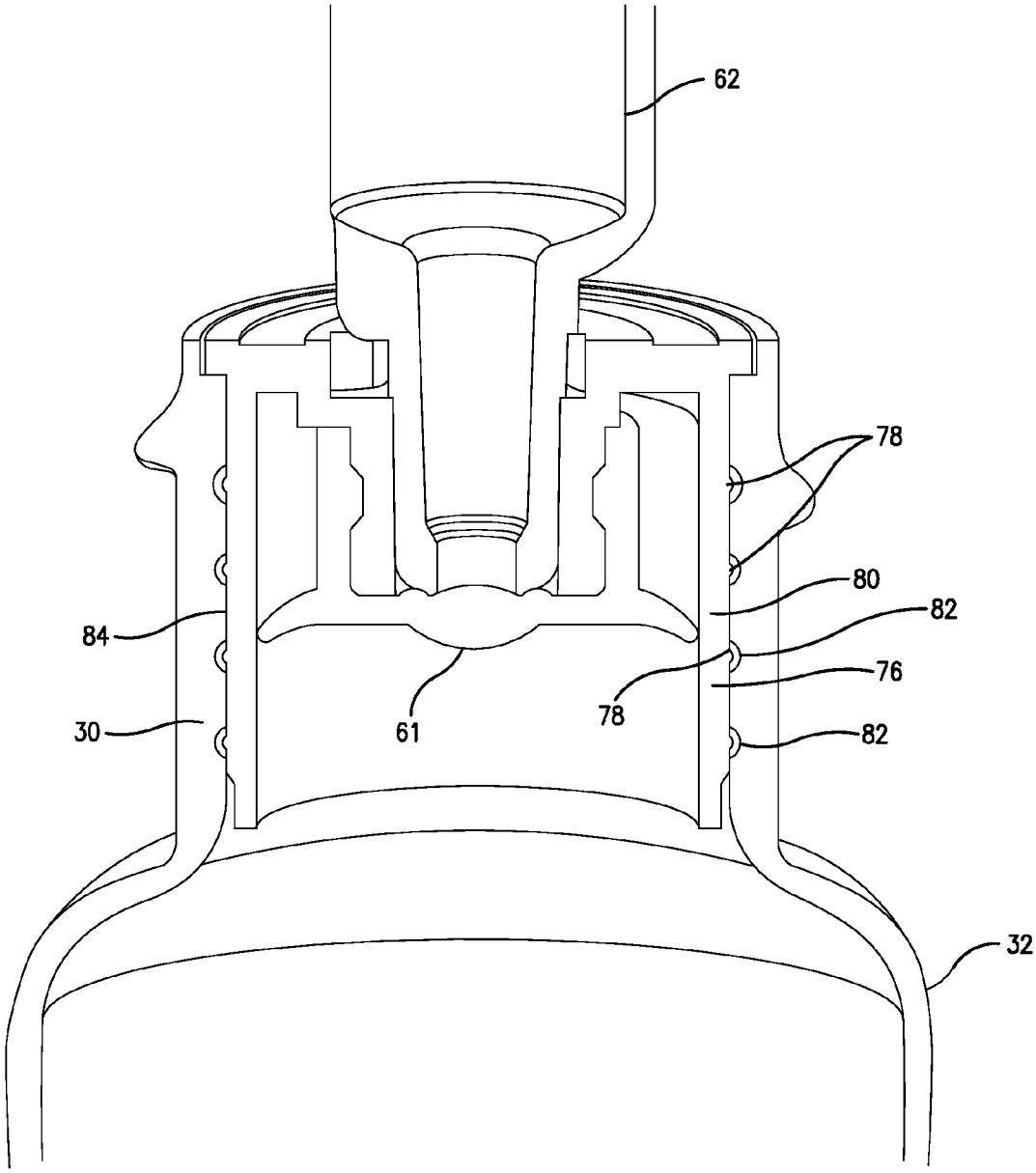
FIG. 3 is a cross-sectional view of an alternative embodiment of a bottle adapter of the present invention in its operative position interfitted into the top of a bottle.

Turning now to FIG. 3, there is shown a cross-sectional view of a further embodiment of the present invention where like identification numbers are used on the same components described and explained with respect to FIG. 2. In this embodiment, the adapter 76 has a plurality of annular bumps 78 formed on the exterior of a cylindrical portion 80 that has a larger diameter than the cylindrical portion 34 of FIG. 2 such that the annular bumps 78 interfit into annular recesses 82 formed in the interior surface 84 of the neck 30 of the bottle 32. As such when the adapter 76 is pressed into the neck 30, the annular bumps 78 snap into the annular recesses 82 to positively secure the adapter 76 to the bottle 32.

Figure 4:
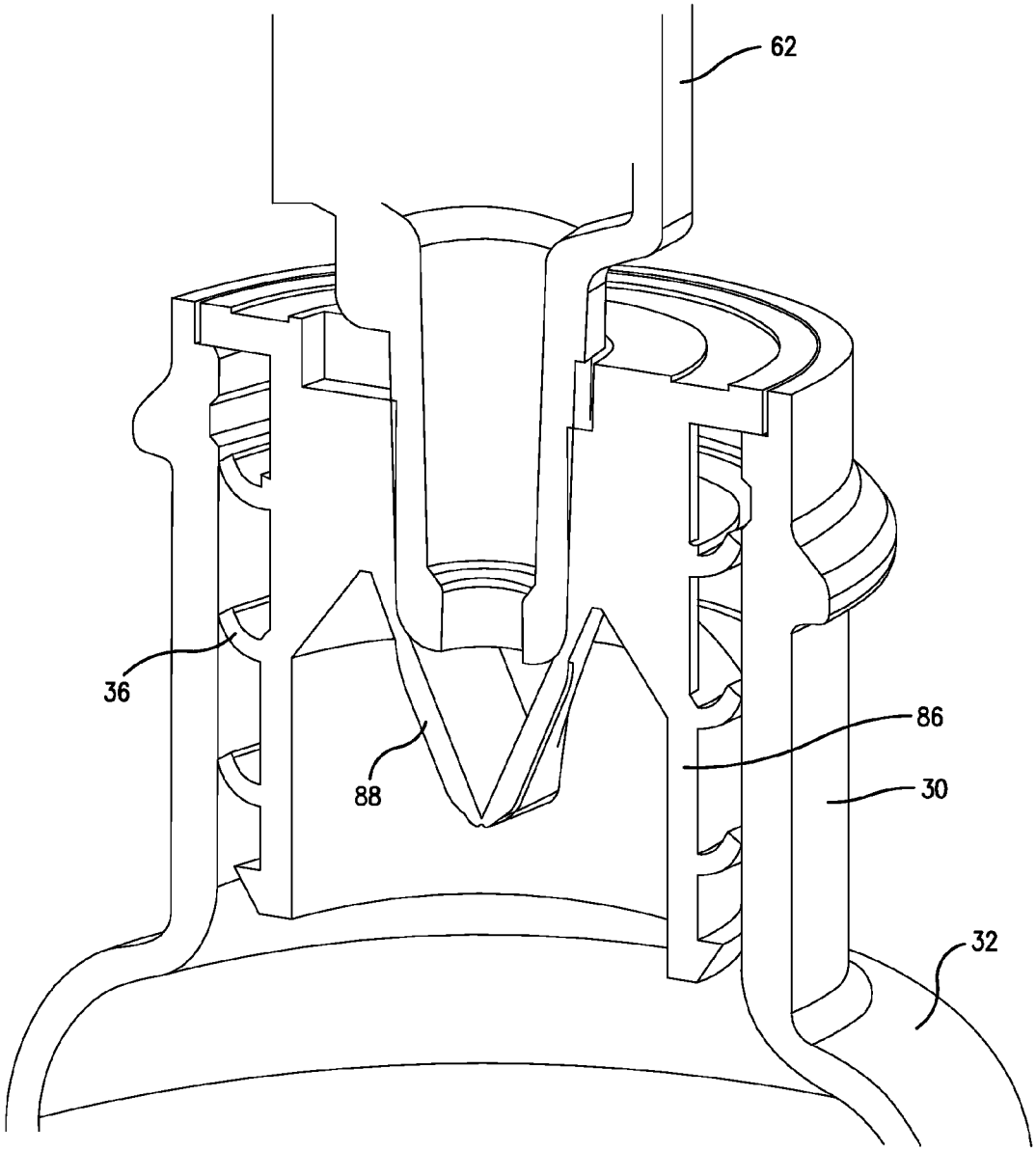
FIG. 4 is a cross-sectional view of a further alternative embodiment of a bottle adapter of the present invention in its operative position interfitted into the top of a bottle.

Turning now to FIG. 4, there is shown a cross sectional view of a further exemplary embodiment of the present invention, again using like numbers for those previously used on corresponding components. In this embodiment, however, the adapter 86 is a one-piece molded construction and the valve 88 is molded into the adapter 86 as a single molded piece.

Figure 5:
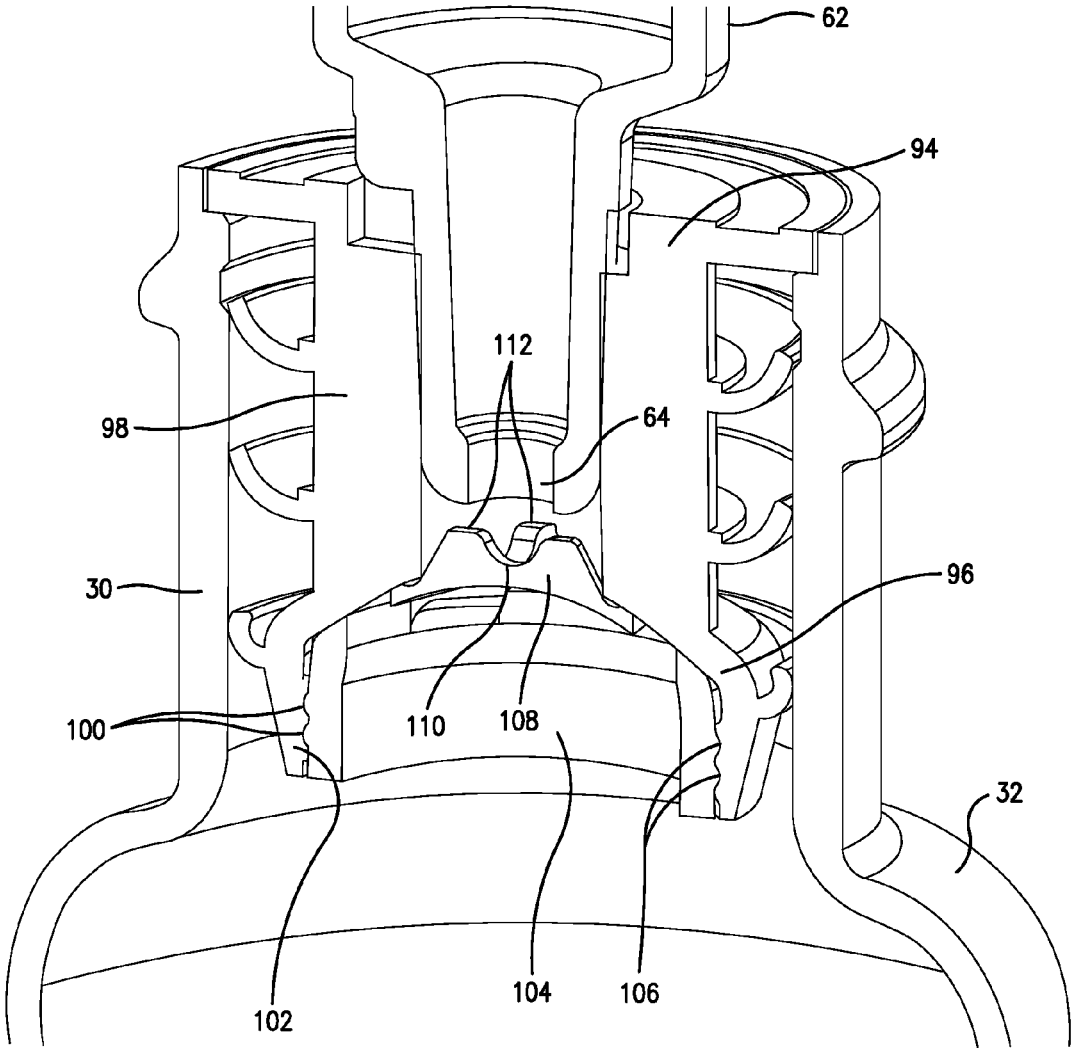
FIG. 5 is a cross-sectional view of a still further alternative embodiment of a bottle adapter of the present invention in its operative position interfitted into the top of a bottle.

Turning now to FIG. 5, there is shown a shown a cross-sectional view of a further embodiment of the present invention and, again like numbers are used to identify corresponding components described in the previous Figures. In this embodiment, the adapter 94 is pressed into the neck 30 of the bottle 32 in the same manner as previously described. With this embodiment, however, the valve 96 comprises a two piece unit, with the cylindrical portion 98 having a plurality of annular recesses 100 formed at is lower portion 102. A dome-shaped valve member 104 interfits into the lower portion 102 and has annular ribs 106 formed thereon that snap into the annular recesses 100 in the lower portion 102 of the valve 96.

The dome shaped valve member 104 therefore snaps onto the lower portion 120 of the cylindrical portion 98 to securely join the two components.

The dome shaped valve member 104 has an upper portion 108 forming a plurality of serrations 110 that, in turn, create a plurality of upper surfaces 112. Accordingly, as the distal end 64 of dispenser 62 moves downwardly, that distal end 64 contacts the upper surfaces 112 of the dome shaped valve member 104 and further downward movement causes upper portion 108 of the dome shaped valve member 104 to distort and move downwardly, thereby opening a passageway from the bottle 32 through the serrations 110 to enter the dispenser 62.

Figure 6:
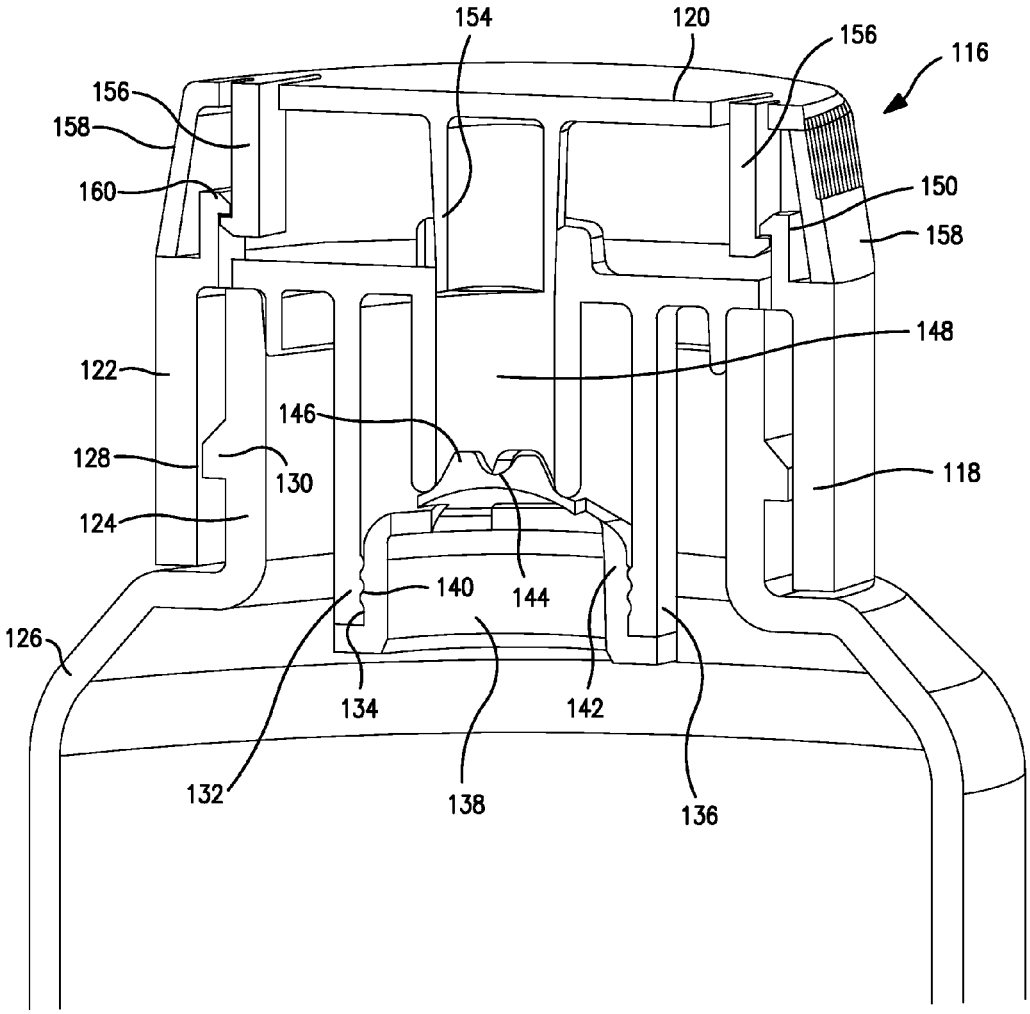
FIG. 6 is a cross-sectional view of a cap with its upper lid in the closed position closing the top of a bottle.
Figure 7:
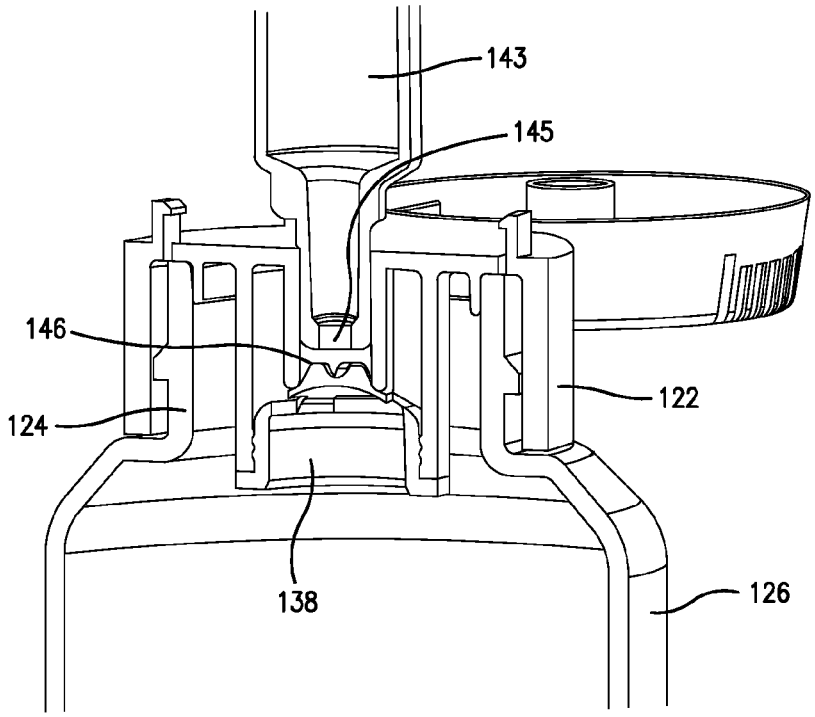
FIG. 7 is a cross-sectional view of the cap of FIG. 6 with the upper lid in the open position.
Figure 8:
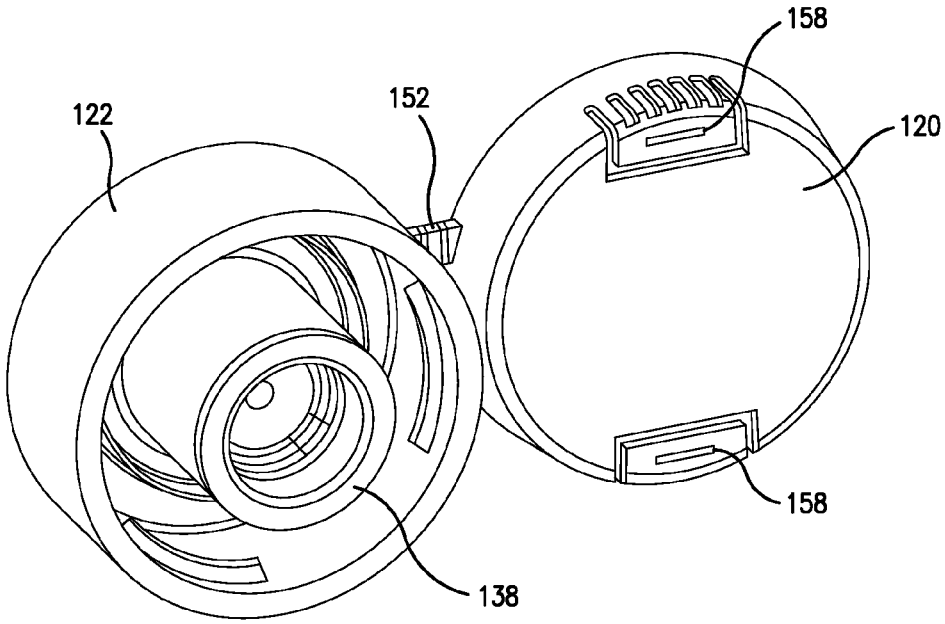
FIG. 8 is a perspective view of the cap of FIG. 6.

Turning now to FIGS. 6, 7 and 8, there is shown a cross-sectional view of a cap 116 constructed in accordance with the present invention, a cross-sectional view of the cap 116 of FIG. 6 in the open position and a perspective view of the FIG. 6 cap 116, respectively.

Accordingly, as can be seen in FIGS. 6-8, the cap 116 is comprised of a lower body 118 and an upper lid 120 that is movable between a closed position and an open position as will be later explained. In this embodiment, the lower body 118 has an outer cylindrical portion 122 the surrounds the neck 124 of the bottle 126. There is a indention 128 formed in the lower body 118 that interfits with a projection 130 provided on the neck 124 of the bottle 126 such that the lower body 118 can be easily snapped onto the bottle neck 124 to securely assemble the cap 116 to the bottle 126.

As can also be seen, the lower body 118 includes an inner cylindrical portion 132 having a plurality of annular recesses 134 formed at its lower portion 136. A dome-shaped valve member 138 interfits into the lower portion 136 and has annular ribs 140 formed thereon that snap into the annular recesses 134 in the lower portion 136 of the lower body 118. The dome shaped valve member 138 therefore snaps onto the lower portion 136 of the inner cylindrical portion 132 to securely join the two components.

The dome shaped valve member 138 has an upper portion 142 forming a plurality of serrations 144 that, in turn, create a plurality of upper surfaces 146. Accordingly, as the distal end 145 of the dispenser 143 moves downwardly, that distal end 145 contacts the upper surfaces 146 of the dome shaped valve member 138 and further downward movement causes upper portion 142 of the dome shaped valve member 138 to distort and move downwardly, thereby opening a passageway from the bottle 126 through the serrations 144 to enter the dispenser 143 in the same manner as described with respect to FIG. 5.

The lower body 118 also includes a central opening 148 that receives the dispenser 143 in accessing the medicine within the bottle 126. There is also a pair of upward latches 150 provided on the lower body 118 that extend upwardly and serve a purpose to be later explained.

Taking then, the upper lid 120, the upper lid 120 is hingedly affixed to the lower body 118 and in the exemplary embodiment that hinged connection can be by means of a living hinge 152. The upper lid 120 has a closed position as shown in FIG. 6 and an open position as shown in FIG. 7. As can be seen, in the closed position of FIG. 6, the upper lid 120 includes a downwardly extending plug 154 that interfits into and closes the central opening 148.

Also, in the closed position of FIG. 6, there are downward latches 156 that latch with the upward latches 150 of the lower body 118 to retain the upper lid 120 in its closed position. In order to move the upper lid 120 from its latched, closed position of FIG. 6 to its open position of FIG. 7, there are release buttons 158 formed in the upper lid 120 that are adapted to be pressed inwardly so as to move the downward latches 156 inwardly to disengage from the upward latches 150, thereby releasing the upper lid 120 from its latched, closed position so that the upper lid 120 can readily be moved to its open position.

Figure 9:
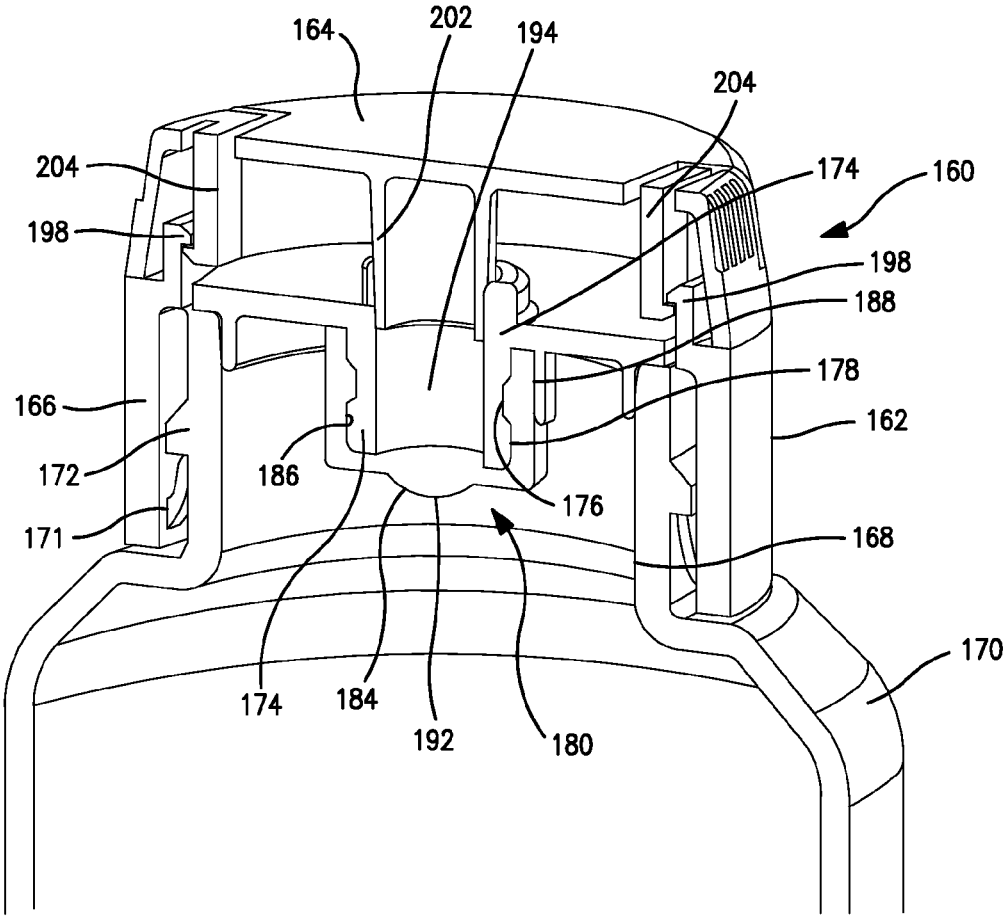
FIG. 9 is a is a cross-sectional view of an other embodiment of a cap of the present invention with its upper lid in the closed position closing the top of a bottle.
Figure 10:
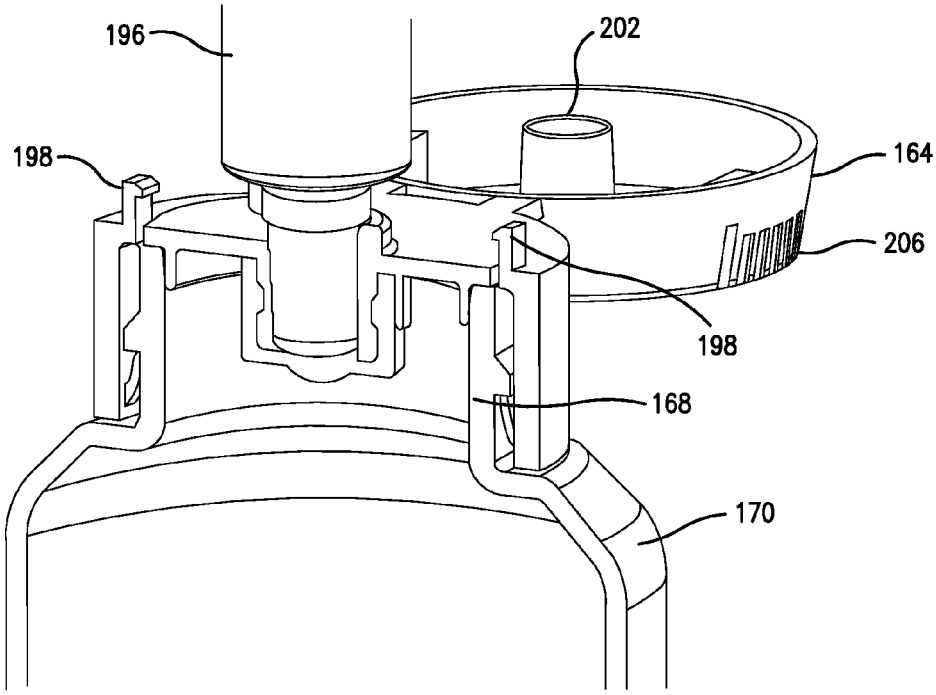
FIG. 10 is a cross-sectional view of the cap of FIG. 9 with the upper lid in the open position.
Figure 11:
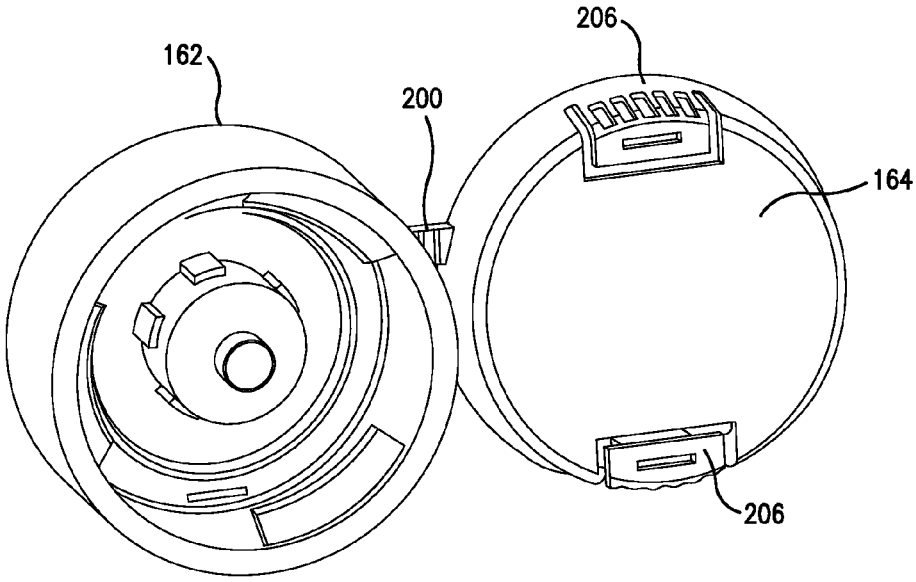
FIG. 11 is a perspective view of the cap of FIG. 9.

Turning now to FIGS. 9, 10 and 11, there is shown a cross-sectional view of a cap 160 constructed in accordance with the present invention, a cross-sectional view of the cap 160 of FIG. 9 in the open position and a perspective view of the FIG. 9 cap 160, respectively.

Accordingly, as can be seen in FIGS. 9-11, the cap 160 is comprised of a lower body 162 and an upper lid 164 that is movable between a closed position and an open position as will be later explained. In this embodiment, the lower body 162 has an outer cylindrical portion 166 that surrounds the neck 168 of the bottle 170. There is a fin 171 formed on the lower body 162 the interfits with a projection 172 provided on the neck 168 of the bottle 170 such that the lower body 162 can be easily snapped onto the bottle neck 168 to securely assemble the cap 160 to the bottle 170.

As can also be seen, the lower body 162 includes an inner cylindrical portion 174 having an annular recesses 176 formed at is lower portion 178. A valve 180 is located in the lower portion 178 of the inner cylindrical portion 174 and is comprised of a valve body 184 made of a molded material having an inner surface 186 of a diameter that fits closely over the inner cylindrical portion 174. An annular projection 188 is formed on the inner surface of the valve body 184 that interfits into the annular recess 176 formed on the inner cylindrical portion 174 such that the valve body 184 can be readily snapped on to the inner cylindrical portion 174 in constructing the cap 160.

The lower portion of the valve body 184 is formed as a duck bill valve 192 that is normally closed but opens when an object is inserted therethrough and the function and purpose of the duck bill valve 192 is the same as that discussed with respect to FIG. 2 as will be appreciated buy those skilled in the art, the present invention is not limited to the use of duckbill valves as other valve configurations and shapes maybe used without departing form the spirit of the invention.

The lower body 162 also includes a central opening 194 that receives a dispenser or syringe 196 in accessing the medicine within the bottle 170. Again, as with the embodiment of FIGS. 6-8, there is a pair of upward latches 198 provided on the lower body 162 that extend upwardly Again the upper lid 164 is hingedly affixed to the lower body 162 and in the exemplary embodiment that hinged connection can be by means of a living hinge 200. The upper lid 164 has a closed position as shown in FIG. 9 and an open position as shown in FIG. 10. As can be seen in the closed position of FIG. 9, the upper lid 164 includes a downwardly extending plug 202 that interfits into and closes the central opening 194.

Also, in the closed position of FIG. 9, there are downward latches 204 that latch with the upward latches 198 of the lower body 162 to retain the upper lid 164 in its closed position. In order to move the upper lid 164 from its latched, closed position of FIG. 9 to its open position of FIG. 10, there are release buttons 206 formed in the upper lid 164 that are adapted to be pressed inwardly so as to move the downward latches 204 inwardly to disengage from the upward latches 198, thereby releasing the upper lid 164 from its latched, closed position so that the upper lid 164 can readily be moved to its open position.

Figure 12:
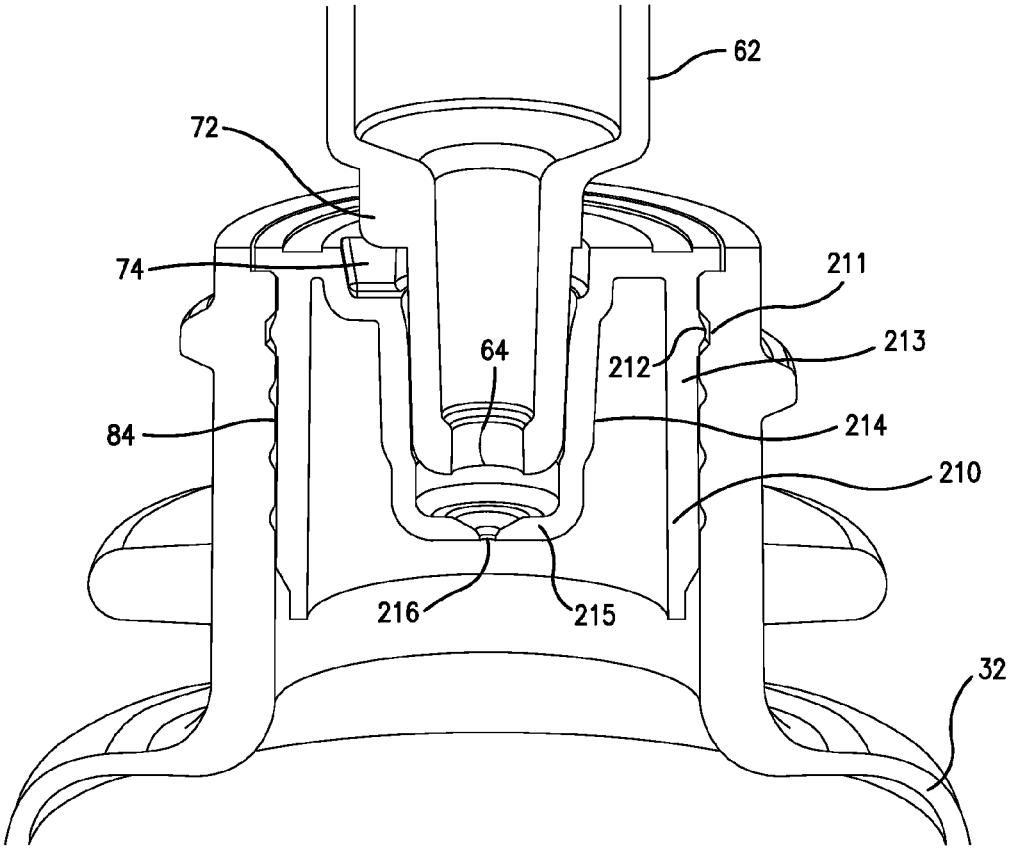
FIG. 12 is a cross-sectional view of a further embodiment of a bottle adapter of the present invention in its operative position interfitted into the top of a bottle.

Turning now to FIG. 12, there is shown a cross-sectional view of a further embodiment of the present invention where like identification numbers are used on the same components described and explained with respect to FIGS. 2 and 3. In this embodiment, the adapter 210 has an annular bump 212 formed on the exterior of a cylindrical portion 213 that has a larger diameter than the cylindrical portion 34 of FIG. 2 such that the annular bump 212 interfits into annular recesses 211 formed in the interior surface 84 of the neck 30 of the bottle 32. As such when the adapter 210 is pressed into the neck 30, the annular bump 212 snaps into the annular recesses 211 to positively secure the adapter 210 to the bottle 32. The adapter 210 further includes an inner cylindrical portion 214 extending downwardly from the upper flange 48 in the direction toward the bottle 32. Cylindrical portion 214 has a inwardly sloping bottom portion 215 that narrows central opening 40 to orifice 216. In this embodiment, when key 72 on dispenser 62 is properly aligned with keyway 74, dispenser 62 can be inserted completely into cylindrical portion 214. In this position, distal end 64 contacts bottom portion 215 and medicine from bottle 32 can be dispensed through orifice 216 into dispenser 62. The reduction in the diameter of central opening 40 down to the diameter of orifice 216 severely limits and greatly reduces access to the medicine within bottle 32.

Those skilled in the art will readily recognize numerous adaptations and modifications which can be made to the pressed in bottle adapter, bottle and dispenser of the present invention which will result in an improved adapter, bottle and dispenser, yet all of which will fall within the scope and spirit of the present invention as defined in the following claims. Accordingly, the invention is to be limited only by the following claims and their equivalents.

What is claimed is:

1. A system for removing the contents of a bottle, the system comprising:

an adapter configured to be interfitted into the bottle and having a seal for application against an internal surface of the bottle, the adapter having a central opening extending therethrough and a distal end configured for extending into the neck of the bottle;

a normally closed valve located proximate the distal end of the adapter closing the central opening, the normally closed valve comprising leaflets movably joined at a parting line slit; and a dispenser including a barrel portion and a narrowed tip portion at a distal end, the narrowed tip portion adapted to be inserted into the central opening of the adapter and dimensioned so as to penetrate no further than a predetermined distance into the an interior cavity of the normally closed valve to open the normally closed valve and thereby the central opening for removal of the contents of the bottle, wherein, when penetrating to the predetermined distance, the narrowed tip portion enters the interior cavity of the normally closed valve to interferingly and laterally expand sidewalls of the normally closed valve to open the valve without contacting any portion of the parting line slit.

2. The system of claim 1 further comprising a keying system that selectively prevents the narrowed tip portion of the dispenser from penetrating as much as the predetermined distance into the interior cavity of the normally closed valve.

3. The system of claim 2 wherein the keying system prevents the narrowed tip portion from penetrating as much as the predetermined distance into the bottle unless the dispenser is in a predetermined radial orientation with respect to the adapter.

4. The system of claim 2 wherein the keying system comprises a key formed on the narrowed tip portion of the dispenser and a keyway formed in the adapter and wherein the key must align and enter into the keyway to allow the dispenser to penetrate as much as the predetermined distance into the bottle.

5. The system of claim 1 wherein the adapter includes a cap that can selectively open and close the central opening.

6. The system of claim 5 wherein the cap is comprised of a lower body and an upper lid that is hingedly affixed to the lower body and the upper lid moves between a closed position where the upper lid closes the central opening and an open position where the central opening is open.

7. The system of claim 1 further comprising the bottle having a neck forming the internal surface.

8. The system of claim 7 wherein the internal surface of the neck has at least one annular recess and the adapter has an external surface having at least one annular bump adapted to interfit into the at least one annular recess.

9. The system of claim 1 wherein the normally closed valve is integrally molded into the adapter.

10. The system of claim 1 wherein the normally closed valve is affixed to the distal end of the adapter.

11. The system of claim 1 wherein the normally closed valve is a duck billed valve.

12. The system of claim 1 wherein the adapter includes a cap comprised of a lower body and an upper lid that is hingedly affixed to the lower body and the upper lid moves between a closed position where the upper lid closes the central opening and an open position where the central opening is open.

13. The system of claim 12 wherein the upper lid is hingedly affixed to the lower body by means of a living hinge.

14. The system of claim 12 wherein the cap has a locking mechanism to retain the upper lid positively in its closed position.

15. The system of claim 12 wherein the cap has an upper latch formed on the upper lid and a lower latch formed on the lower body that latch together when the upper lid is in its closed position and wherein the lower latch or upper latch is manually movable to unlatch the upper and lower latch to allow the upper lid to move to its open position.

16. The system of claim 7 wherein the neck has a proximal rim and the adapter has a top surface that is recessed within the proximal rim to be level with the proximal rim of the neck.

17. A method of removing the contents of a bottle comprising the steps of:

providing a bottle having a neck forming an internal surface, the bottle having an adapter interfitted into the bottle and sealed against the internal surface, the adapter having a central opening extending therethrough and a distal end extending into the neck, a normally closed valve located proximate the distal end of the adapter for selectively opening and closing the central opening, and the adapter having a keyway formed therein, providing a dispenser having a barrel portion, a narrowed tip portion and a key formed on the narrowed tip portion;

aligning the key on the narrowed tip portion with the keyway formed on the adapter; and inserting the dispenser into the bottle with the key entering the keyway, wherein the normally closed valve comprises leaflets movably joined at a parting line slit for opening and closing the valve, and wherein the key and keyway are configured so that the narrowed tip portion of the dispenser may penetrate no further than a predetermined distance into an interior cavity of the normally closed valve, and the narrowed tip portion and normally closed valve are configured so that the inserting step causes the narrowed tip portion to interferingly and laterally expand sidewalls of the normally closed valve to open the valve without contacting any portion of the parting line slit of the normally closed valve, and dimensioned so as to penetrate no further than a predetermined distance into the an interior cavity of the normally closed valve to open the normally closed valve and thereby said central opening for removal of the contents of the bottle, wherein, when penetrating to the predetermined distance, the narrowed tip portion enters the interior cavity of the normally closed valve to interferingly and laterally expand sidewalls of the normally closed valve to open the valve without contacting any portion of the parting line slit.

18. The method of claim 17 wherein the step of aligning comprises rotating the dispenser radially to align the key with the keyway.

* * * * *